US009734937B2

(12) United States Patent
Aoyama et al.

(10) Patent No.: US 9,734,937 B2
(45) Date of Patent: Aug. 15, 2017

(54) SOFT DILUTE-COPPER ALLOY WIRE, SOFT DILUTE-COPPER ALLOY TWISTED WIRE, AND INSULATED WIRE, COAXIAL CABLE, AND COMPOSITE CABLE USING THESE

(75) Inventors: Seigi Aoyama, Kitaibaraki (JP); Toru Sumi, Hitachi (JP); Hiromitsu Kuroda, Hitachi (JP); Hideyuki Sagawa, Tokai-mura (JP)

(73) Assignee: HITACHI METALS, LTD., Tokyo (JP)

( * ) Notice: Subject to any disclaimer, the term of this patent is extended or adjusted under 35 U.S.C. 154(b) by 560 days.

(21) Appl. No.: 14/005,224

(22) PCT Filed: Mar. 16, 2012

(86) PCT No.: PCT/JP2012/056852

§ 371 (c)(1),
(2), (4) Date: Sep. 13, 2013

(87) PCT Pub. No.: WO2012/124804

PCT Pub. Date: Sep. 20, 2012

(65) Prior Publication Data

US 2014/0000932 A1 Jan. 2, 2014

(30) Foreign Application Priority Data

Mar. 17, 2011 (JP) ..... 2011-058683

(51) Int. Cl.
*H01B 7/04* (2006.01)
*C22C 9/00* (2006.01)
(Continued)

(52) U.S. Cl.
CPC ..... *H01B 7/04* (2013.01); *C22C 1/02* (2013.01); *C22C 9/00* (2013.01); *C22F 1/08* (2013.01); *H01B 1/026* (2013.01)

(58) Field of Classification Search
CPC .. C22F 1/08; H01B 1/026; H01B 7/04; C22C 9/00
See application file for complete search history.

(56) References Cited

U.S. PATENT DOCUMENTS 5,077,005 A * 12/1991 Kato ..... H01B 1/026 420/469
8,004,094 B2 * 8/2011 Uno ..... B23K 35/302 257/784
(Continued)

FOREIGN PATENT DOCUMENTS

JP 6-179932 A 6/1994
JP 9-157775 A 6/1997
(Continued)

OTHER PUBLICATIONS

International Search Report in PCT/JP2012/056852 dated Jun. 19, 2012 (English Translation Thereof).

*Primary Examiner* — Jessee Roe
*Assistant Examiner* — Jeremy Jones
(74) *Attorney, Agent, or Firm* — McGinn IP Law Group, PLLC

(57) ABSTRACT

Provided are a soft dilute-copper alloy wire and soft dilute-copper alloy twisted wire which have high electrical conductivity and high bending life and can limit disconnection during use compared with oxygen-free copper wire, and also provided are an insulated wire, coaxial cable, and composite cable using the soft dilute-copper alloy wire and soft dilute-copper alloy twisted wire. The soft dilute-copper alloy wire is subjected to annealing treatment by elongation processing of soft dilute-copper alloy material comprising copper and an additive element selected from the group consisting of Ti, Mg, Zr, Nb, Ca, V, Ni, Hf, Fe, Mn and Cr, with inevitable impurities as the balance, wherein the soft dilute-copper alloy wire has an average grain size that is 20 μm or less in a surface layer having a depth of 50 μm from the surface, and
(Continued)

an elongation value that is at least 1% higher than the average elongation value of oxygen-free copper wire that has been subjected to the aforementioned annealing treatment.

18 Claims, 18 Drawing Sheets

(51) Int. Cl.

| | |
|---|---|
| ***H01B 1/02*** | (2006.01) |
| ***C22F 1/08*** | (2006.01) |
| ***C22C 1/02*** | (2006.01) |

(56) References Cited

U.S. PATENT DOCUMENTS

| | | | | |
|---|---|---|---|---|
| 2010/0230069 | A1* | 9/2010 | Aoyama | B21B 1/463 164/462 |
| 2010/0263905 | A1* | 10/2010 | Aoyama | B22D 21/025 174/107 |
| 2012/0097422 | A1 | 4/2012 | Sumi et al. | |
| 2012/0305286 | A1 | 12/2012 | Aoyama et al. | |
| 2014/0000932 | A1 | 1/2014 | Aoyama et al. | |

FOREIGN PATENT DOCUMENTS

| | | | |
|---|---|---|---|
| JP | 09-256084 | A | 9/1997 |
| JP | 2002-294369 | A | 10/2002 |
| JP | 2002-363668 | A | 12/2002 |
| JP | 2008-1933 | A | 1/2008 |
| JP | 2008-41447 | A | 2/2008 |
| JP | 2011-179110 | A | 9/2011 |

* cited by examiner

SOFT DILUTE-COPPER ALLOY WIRE, SOFT DILUTE-COPPER ALLOY TWISTED WIRE, AND INSULATED WIRE, COAXIAL CABLE, AND COMPOSITE CABLE USING THESE

TECHNICAL FIELD

The invention relates to a soft dilute-copper alloy wire and a soft dilute-copper alloy twisted wire having high conductivity and a long bending life even though being formed of a soft material, and an insulated wire, a coaxial cable and a composite cable using the same.

BACKGROUND ART

In recent science and technology, electricity is used for everything such as electric power as a power source or electric signals, etc., and conductors such as cables or lead wires are used for transmission thereof. Metals having high conductivity such as copper or silver are used as a material of such conductors, and particularly, copper wires are used very often in view of the cost.

Although it is generically called "copper", it is broadly classified into hard copper and soft copper depending on a molecular arrangement thereof. Then, copper having desired properties is used depending on the intended use.

A hard copper wire is often used for a lead wire for electronic component but a rigid hard copper wire is unsuitable for, e.g., a cable used in electronic devices, etc., such as medical equipment, industrial robot or notebook computer since it is used in an environment in which a combined external force of extreme bending, torsion and tension, etc., is repeatedly applied, and a soft copper wire is therefore used instead.

A conductor used for such an application is required to have conflicting characteristics, which are good conductivity (high conductivity) and good bending characteristics, and a copper material maintaining high conductivity and flexibility has been thus developed to date (see Patent Literature 1 and Patent Literature 2).

For example, the invention according to Patent Literature 1 is the invention relating to a flexible cable conductor with good tensile strength, elongation and conductivity, and particularly, a flexible cable conductor is described in which a wire rod is formed of a copper alloy made of oxygen-free copper with a purity of not less than 99.99 wt % containing indium with a purity of not less than 99.99 wt % at 0.05 to 0.70 mass % and P with a purity of not less than 99.9 wt % at a concentration range of 0.0001 to 0.003 mass %.

Meanwhile, the invention according to Patent Literature 2 describes a flexible copper alloy wire containing 0.1 to 1.0 wt % of indium, 0.01 to 0.1 wt % of boron and copper as the remainder.

CITATION LIST

Patent Literature

[PTL 1] JP-A-2002-363668
[PTL 2] JP-A-H09-256084

SUMMARY OF INVENTION

Technical Problem

However, in the invention according to PTL 1 which is the invention only related to a hard copper wire, flexibility is not specifically evaluated and a soft copper wire having better flexibility is not examined at all. In addition, conductivity is low due to the large amount of additive elements. Therefore, it cannot be considered that the soft copper wire is sufficiently examined. Meanwhile, in the invention according to PTL 2 which is the invention related to a soft copper wire, conductivity is low due to the large amount of additive elements in the same manner as the invention according to PTL 1.

On the other hand, it is considered that high conductivity is ensured by selecting a highly conductive copper material such as oxygen-free copper (OFC), etc., as a raw copper material.

In this regard, the approach to improve flexibility by drawing a copper wire rod at an increased reduction ratio and thereby providing a finer crystalline structure in the oxygen-free copper wire may be effective when oxygen-free copper (OFC) is used as raw material without adding any other elements in order to maintain high conductivity, but in this case, there is a problem that it is not applicable as a soft wire rod due to work hardening by the wire drawing process even though it suitable for application as a hard wire rod.

Meanwhile, insulated wires or cables using a soft wire are excellent in flexibility but breaking of wire may generally occur during use. For example, insulated copper wires used for multiwire circuit board have a following problem.

That is, the multiwire circuit board is generally manufactured by arranging and fusing plural insulated copper wires (oxygen-free copper wires) onto an insulating substrate having adhesive so that the insulated copper wires intersect one another, and now a quadruple crossing wire is proposed. There is a problem that, in a crossover portion in which existing wirings intersect, an extra length in a height direction is required but an apparatus cannot feed an insulated copper wire required in a height direction by a feeder during a short period of time in which a stylus passes through the crossover portion, the insulated copper wire is therefore stretched at the crossover portion and breaking of wire occurs when being excessively stretched.

Therefore, it is an object of the invention to provide a soft dilute-copper alloy wire and a soft dilute-copper alloy twisted wire which have high conductivity as well as a long bending life and allows breaking of wire during use to be suppressed as compared to an oxygen-free copper wire, and also to provide an insulated wire, a coaxial cable and a composite cable using the same.

Means for Solving the Problems (1) According to one embodiment of the invention, a soft dilute-copper alloy wire comprises:

a soft dilute-copper material that comprises a copper and an additive element selected from the group consisting of Ti, Mg, Zr, Nb, Ca, V, Ni, Hf, Fe, Mn and Cr, and is subjected to wire drawing processing and an annealing treatment, wherein the wire further comprises:

an average crystal grain size of not more than 20 μm in a surface layer having a depth of 50 μm from a surface, and an elongation value of not less than 1% more than an average elongation value of an oxygen-free copper wire that is subjected to the annealing treatment.

(2) According to another embodiment of the invention, a soft dilute-copper alloy wire comprises a soft dilute-copper alloy wire comprising a soft dilute-copper material that comprises a copper and an additive element selected from the group consisting of Ti, Mg, Zr, Nb, Ca, V, Ni, Hf, Fe, Mn and Cr and is subjected to a wire drawing processing and an annealing treatment, wherein the wire further comprises:

an average crystal grain size is not more than 20 μm in a surface layer having a depth of 50 μm from a surface; and an elongation value of not less than 40% after the wire drawing processing at a reduction ratio of 90%.

The soft dilute-copper alloy wire according to the above-mentioned embodiment (1) or (2) can be modified or changed as follows.

(i) The soft dilute-copper alloy wire is formed by processing and annealing the soft dilute-copper alloy material containing not less than 2 mass ppm and not more than 12 mass ppm of sulfur, more than 2 mass ppm and not more than 30 mass ppm of oxygen and not less than 4 mass ppm and not more than 55 mass ppm of Ti.

(ii) The wire is not less than 98% IACS in conductivity.

(iii) The wire further comprises a plating layer formed on a surface thereof.

(3) According to another embodiment of the invention, a soft dilute-copper alloy twisted wire comprises a plurality of ones of the soft dilute-copper alloy wire according to the above-mentioned embodiment (1) or (2) that are twisted together.

(4) According to another embodiment of the invention, an insulated wire comprises the soft dilute-copper alloy wire or the soft dilute-copper alloy twisted wire according to the above-mentioned embodiments (1) to (3) and an insulation layer thereon.

(5) According to another embodiment of the invention, a coaxial cable comprises a central conductor formed by twisting together a plurality of ones of the soft dilute-copper alloy wire according to the above-mentioned embodiment (1) or (2), an insulation cover formed on an outer periphery of the central conductor, an outer conductor comprising copper or copper alloy arranged on an outer periphery of the insulation cover, and a jacket layer provided on an outer periphery of the outer conductor.

(6) According to another embodiment of the invention, a composite cable comprises a plurality of ones of the insulated wire according to the above-mentioned embodiment (4) or the coaxial cables according to the above-mentioned embodiment (5) arranged in a shield layer, and a sheath provided on an outer periphery of the shield layer.

Effect of the Invention

According to embodiments of the invention, provided are a soft dilute-copper alloy wire and a soft dilute-copper alloy twisted wire which have high conductivity as well as a long bending life and allows breaking of wire during use to be suppressed as compared to an oxygen-free copper wire, and also to provide an insulated wire, a coaxial cable and a composite cable using the same.

DESCRIPTION OF EMBODIMENTS

A preferred embodiment of the invention will be described in detail below.

Firstly, an object of the invention is to obtain a soft dilute-copper alloy material as a soft copper material which satisfies a conductivity of 98% IACS (IACS: International Annealed Copper Standard, conductivity is defined as 100% when resistivity is $1.7241\times10^{-8}$ Ωm), 100% IACS, or further, 102% IACS. In addition, a secondary object of the invention is to use a SCR continuous casting and rolling machine to allow stable production in a wide range of manufacturing with less generation of surface flaws. In addition, it is also aiming to develop a material having a softening temperature of not more than 148° C. when a reduction ratio of a wire rod is 90% (e.g., from ϕ8 mm into ϕ2.6 mm).

As for high purity copper (6N, a purity of 99.9999%), the softening temperature at the reduction ratio of 90% is 130° C. Therefore, study was conducted to obtain a raw material as a soft dilute-copper alloy material and the manufacturing conditions thereof which allow stable manufacturing of soft copper so that a conductivity of the soft material is not less than 98% IACS, not less than 100% IACS, or further, not less than 102% IACS at a softening temperature of not less than 130° C. and not more than 148° C. allowing stable production.

Here, a ϕ8 mm (herein ϕ means a diameter) wire rod, which is formed of molten metal of high purity copper (4N) with an oxygen concentration of 1 to 2 mass ppm and having several mass ppm of titanium added thereto, was processed into ϕ2.6 mm (at a reduction ratio of 90%) by using a small continuous casting machine in an experimental laboratory and a softening temperature was then measured. The softening temperature was 160 to 168° C. and cannot be lower. In addition, the conductivity was about 101.7% IACS.

Therefore, it was found that, even though the oxygen concentration is reduced and Ti is added, it is not possible to lower the softening temperature and also the conductivity is poorer than that of high purity copper (6N) which is 102.8% IACS.

The reason why the softening temperature is not lowered is presumed that several mass ppm or more of sulfur is mixed as an inevitable impurity during manufacturing of the molten metal but sulfide such as TiS, etc., is not sufficiently formed by this sulfur and Ti.

Accordingly, following two measures (a) and (b) were examined in the present invention in order to simultaneously solve two problems, reduction in the softening temperature and improvement in the conductivity, and the above-mentioned problems were solved by combining effects of the two measures.

Figure 2:
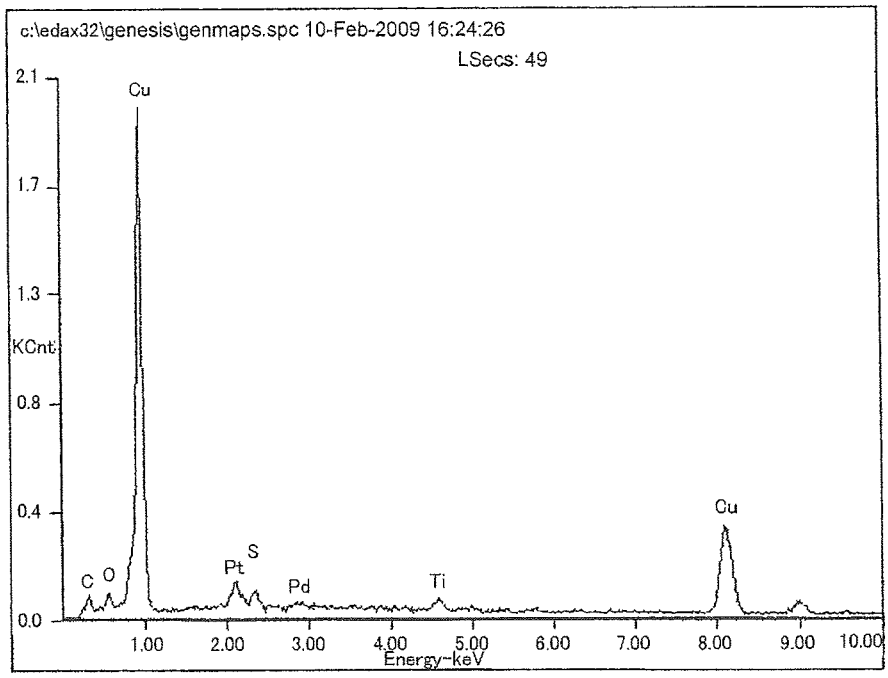
FIG. 2 is a graph showing a result of analysis of FIG. 1.
Figure 3:
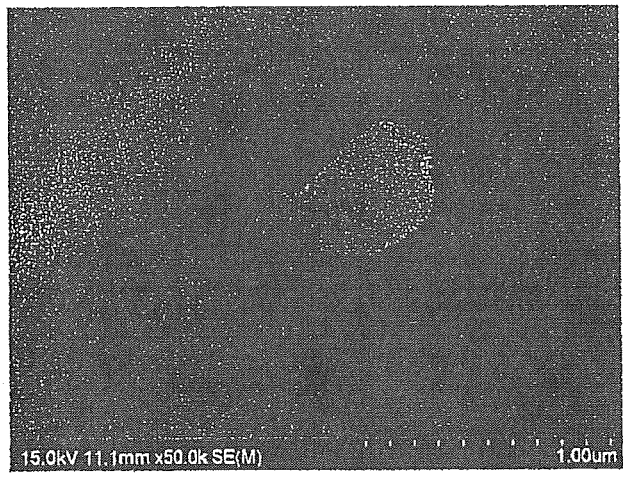
FIG. 3 is a SEM image showing a $TiO_2$ particle.
Figure 4:
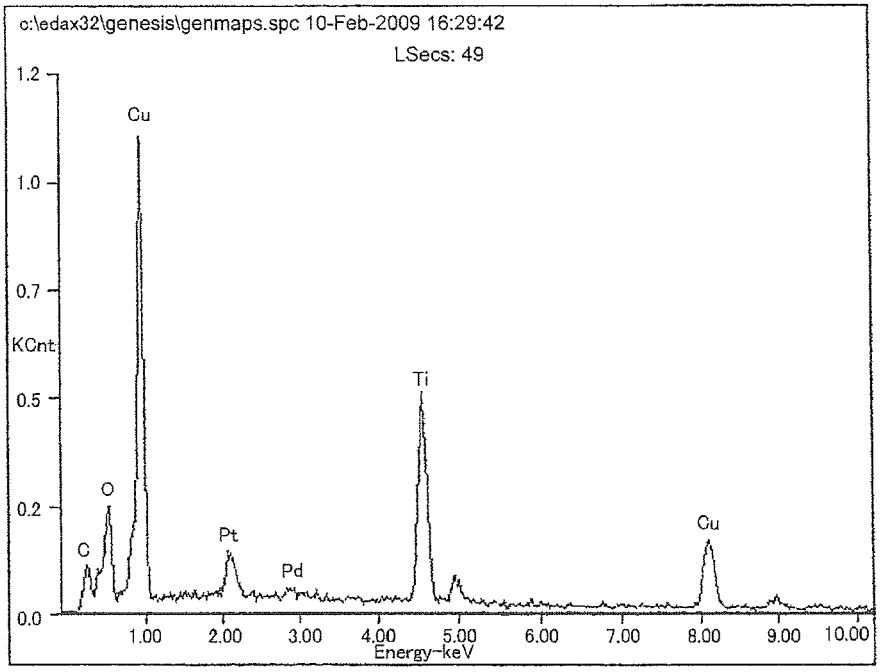
FIG. 4 is a graph showing a result of analysis of FIG. 3.
Figure 5:
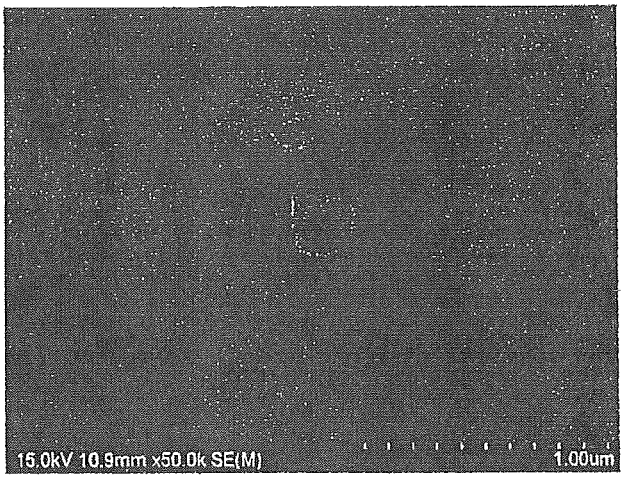
FIG. 5 is a SEM image showing a Ti—O—S particle of the present invention.
Figure 6:
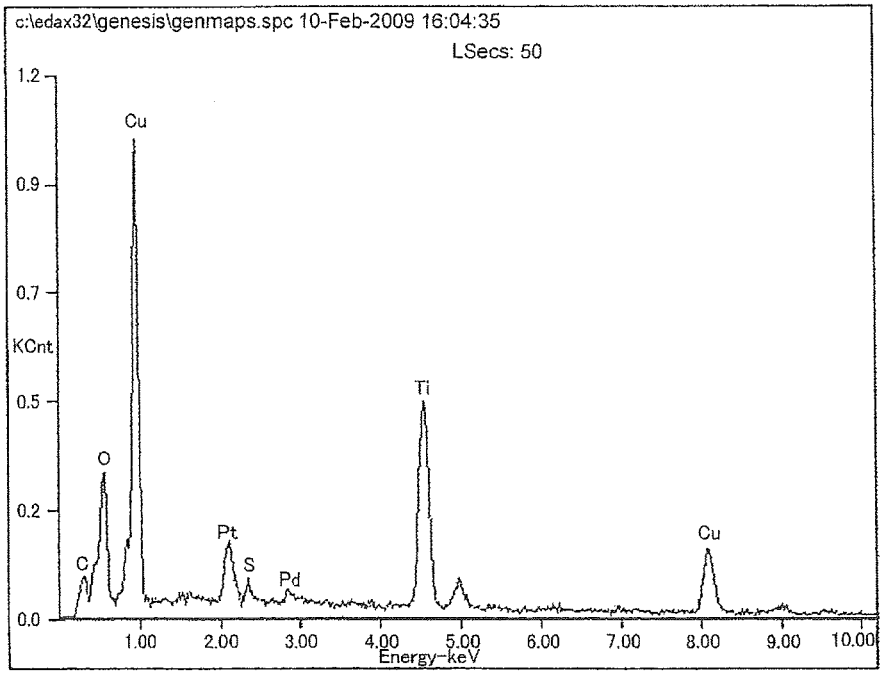
FIG. 6 is a graph showing a result of analysis of FIG. 5.

(a) The oxygen concentration of the material is increased to more than 2 mass ppm, and then, Ti is added thereto. It is considered that, as a result, TiS and titanium oxide ($TiO_2$) or Ti—O—S particles are initially formed in molten copper (see the SEM images of FIGS. 1 and 3 and the results of analysis of FIGS. 2 and 4). It should be noted that Pt and Pd in FIGS. 2, 4 and 6 are vapor deposition elements used for the purpose of observation.

(b) Next, the hot rolling temperature is set to be lower (880 to 550° C.) than that under the typical manufacturing conditions of copper (950 to 600° C.) so that dislocation is introduced into copper for easy precipitation of S. As a result, S is precipitated on the dislocation or is precipitated using titanium oxide ($TiO_2$) as a nucleus, and for example, Ti—O—S particles, etc., are formed in the same manner as in the molten copper (see the SEM image of FIG. 5 and the result of analysis of FIG. 6). In FIGS. 1 to 6, a cross section of a ϕ8 mm copper wire (wire rod) having an oxygen concentration, a sulfur concentration and a Ti concentration which are shown in the third row of Example 1 in Table 1 is evaluated by an SEM observation and an EDX analysis. The observation conditions are an acceleration voltage of 15 keV and an emission current of 10 μA.

The sulfur in the copper is crystallized and precipitated by the above-mentioned measures (a) and (b), and it is thereby possible to provide a copper wire rod satisfying the softening temperature and the conductivity after the cold wire drawing process.

Next, the present invention has the following limitations (1) to (3) in manufacturing conditions using the SCR continuous casting and rolling machine.

(1) Composition

The reason why element(s) selected from the group consisting of Mg, Zr, Nb, Ca, V, Ni, Mn, Hf, Fe, Ti and Cr is chosen as an additive element is that these elements are active elements prone to bind to other elements and thus are prone to bind to S, which allows S to be trapped and a copper base material (matrix) to be highly purified. One or more additive elements may be contained. In addition, other elements and impurities which do not adversely affect the properties of an alloy may be contained in the alloy.

Meanwhile, although it is described that more than 2 and not more than 30 mass ppm of the oxygen content is favorable in the below-described preferred embodiment, more than 2 and 400 mass ppm can be contained within a range providing the properties of the alloy, depending on the added amount of the additive element and the S content.

In order to obtain a soft copper material having a conductivity of not less than 98% IACS, a soft dilute-copper alloy material in which pure copper with inevitable impurities (a base material) contains 3 to 12 mass ppm of sulfur, more than 2 and not more than 30 mass ppm of oxygen and 4 to 55 mass ppm of Ti is used to manufacture a wire rod (a roughly drawn wire). In the present embodiment, so-called low-oxygen copper (LOC) is intended to be used since more than 2 mass ppm and not more than 30 mass ppm of oxygen is contained.

Here, in order to obtain a soft copper material having a conductivity of not less than 100% IACS, a wire rod should be formed of a soft dilute-copper alloy material containing pure copper with inevitable impurities, 2 to 12 mass ppm of sulfur, more than 2 and not more than 30 mass ppm of oxygen and 4 to 37 mass ppm of Ti.

Furthermore, in order to obtain a soft copper material having a conductivity of not less than 102% IACS, a wire rod should be formed of a soft dilute-copper alloy material containing pure copper with inevitable impurities, 3 to 12 mass ppm of sulfur, more than 2 and not more than 30 mass ppm of oxygen and 4 to 25 mass ppm of Ti.

Sulfur is generally introduced into copper during manufacturing of electrolytic copper in the industrial production of pure copper and it is therefore difficult to adjust the sulfur to be not more than 3 mass ppm. The upper limit of the sulfur concentration in general-purpose electrolytic copper is 12 mass ppm.

The amount of oxygen is controlled to be more than 2 mass ppm since the softening temperature is less likely to decrease at a low amount, as described above. On the other hand, surface flaws are likely to be generated during the hot rolling process with too much oxygen, hence, not more than 30 mass ppm.

(2) Dispersed Substance

Desirably, dispersed particles are small in size and a large number of dispersed particles are distributed. The reason for this is because it is required to be small in size and large in number due to its function as a precipitation site of sulfur.

Sulfur and titanium form a compound or an aggregate in the form of TiO, $TiO_2$, TiS or Ti—O—S and the remaining Ti and S are present in the form of solid solution. The soft dilute-copper alloy material is formed so that TiO with a size of not more than 200 nm, $TiO_2$ of not more than 1000 nm, TiS of not more than 200 nm or Ti—O—S of not more than 300 nm is distributed in the crystal grain. The "crystal grain" means a crystalline structure of copper.

Note that, since the size of particle to be formed varies depending on holding time or a cooling status of the molten copper during the casting, it is also necessary to determine casting conditions.

(3) Casting Conditions

A wire rod is manufactured by the SCR continuous casting and rolling where a reduction ratio for processing an ingot rod is 90% (30 mm) to 99.8% (5 mm). In the present embodiment, a method of manufacturing a ϕ8 mm wire rod at a reduction ratio of 99.3% is employed.

(a) The molten copper temperature in a melting furnace is not less than 1100° C. and not more than 1320° C. The molten copper temperature is determined to be not more than 1320° C. since there is a tendency that a blow hole is increased, a flaw is generated and a particle size is enlarged when the temperature is high. It is determined to be not less than 1100° C. because otherwise copper is likely to solidify and the manufacturing is not stable, however, the casting temperature is desirably as low as possible.

(b) The hot rolling temperature is not more than 880° C. at the initial roll and not less than 550° C. at the final roll.

Unlike the typical manufacturing conditions of pure copper, the subject of the invention is to crystallize sulfur in the molten copper and to precipitate the sulfur during the hot rolling, and the molten copper temperature and the hot rolling temperature thus should be set according to the above-mentioned (a) and (b) in order to further decrease a solid solubility limit as an activation energy thereof.

The typical hot rolling temperature is not more than 950° C. at the initial roll and not less than 600° C. at the final roll, however, in order to further decrease the solid solubility limit, the temperature in the invention is determined to be not more than 880° C. at the initial roll and not less than 550° C. at the final roll.

(c) It is possible to obtain a soft dilute-copper alloy wire such that a wire rod with a diameter of ϕ8 mm has a conductivity of not less than 98% IACS, not less than 100% IACS or further not less than 102% IACS, and a wire rod after the cold wire drawing process (e.g., ϕ2.6 mm) has a softening temperature from 130° C. to 148° C.

For the industrial use, a conductivity of not less than 98% IACS is required when it is in the form of soft copper wire which is formed of electrolyte copper and has industrially usable purity, and the softening temperature is not more than 148° C. in light of the industrial value thereof. It is 160 to 165° C. in the case of not adding Ti. The softening temperature of the soft dilute-copper alloy wire is 130° C. to 148° C. based on the obtained data while the softening temperature of high purity copper (6N) is 127 to 130° C. It is considered that this slight difference is caused by inevitable impurities which are not contained in pure copper (6N).

The conductivity of oxygen-free copper is about 101.7% IACS and that of high purity copper (6N) is 102.8% IACS and it is therefore desirable to have a conductivity as close to high purity copper (6N) as possible.

A method to stably manufacture a wire rod to be rolled should be such that, after copper as a base material is melted in a shaft furnace, casting is carried out in a ladle controlled to be a reduced-state, i.e., under reductive gas (CO) atmosphere while controlling concentrations of sulfur, oxygen and Ti which are constituent elements of a dilute alloy. Mixture of copper oxide or large particle size deteriorates quality.

It should be noted that, the additive element to be added to pure copper may include at least one of Mg, Zr, Nb, Ca, V, N, Hf, Fe, Mn and Cr.

Here, the reasons why Ti is selected as an additive element are as follows.

(a) Ti is likely to form a compound by binding to sulfur in the molten copper.

(b) It is possible to process and easy to handle compared to other additive elements such as Zr.

(c) It is cheaper than Nb, etc.

(d) It is likely to be precipitated using oxide as a nucleus.

As described above, the soft dilute-copper alloy wire of the invention can be used as a molten solder plated wire, an enameled wire and wires of soft pure copper, high conductivity copper and soft copper allowing energy at the time of annealing to be reduced, and it is possible to obtain a useful soft dilute-copper alloy wire which has high productivity and is excellent in conductivity, softening temperature and surface quality.

In addition, a plating layer may be formed on a surface of the soft dilute-copper alloy wire of the invention. A plating layer consisting mainly of, e.g., tin, nickel or silver is applicable, or, so-called Pb-free plating may be used therefor.

In addition, it is possible to use as a soft dilute-copper alloy twisted stranded wire by twisting plural soft dilute-copper alloy wires of the invention.

Furthermore, it is possible to use as an insulated wire by providing an insulation layer around the soft dilute-copper alloy wire or soft dilute-copper alloy twisted wire of the invention.

Also, it is possible to use as a coaxial cable by twisting the plural soft dilute-copper alloy wires of the invention to form a central conductor, forming an insulation cover on an outer periphery of the central conductor, arranging an outer conductor formed of copper or copper alloy on an outer periphery of the insulation cover and then providing a jacket layer on an outer periphery of the outer conductor.

In addition, it is possible to use as a composite cable by arranging plural coaxial cables in a shield layer and then providing a sheath on an outer periphery of the shield layer.

The intended purpose of the soft dilute-copper alloy wire of the invention includes, e.g., a wiring material for consumer solar cell, a motor enameled wire conductor, a power cable conductor, a signal line conductor, a molten solder plating material which does not require annealing, a conductor for FPC wiring and usage as a copper material excellent in thermal conductivity and an alternative material of high purity copper, hence, meeting such a wide range of needs. In addition, the shape thereof is not specifically limited and a conductor may have a circular cross section, a rod shape or a rectangular shape.

In addition, although an example in which a wire rod is made by the SCR continuous casting and rolling method and a soft material is made by the hot rolling has been described in the above-mentioned embodiment, a twin-roll continuous casting and rolling method or a Properzi continuous casting and rolling method may be used for manufacturing in the invention.

EXAMPLES

Table 1 shows experimental conditions and results.

TABLE 1

| Experimental material | Oxygen conc. (mass ppm) | S conc. (mass ppm) | Ti conc. (mass ppm) | ϕ2.6 mm Semi-softening temperature (° C.) | ϕ2.6 mm Conductivity of soft material (% IACS) | Evaluation of dispersed particle size | Overall evaluation |
|---|---|---|---|---|---|---|---|
| Comparative material 1 | 1 to less than 2 | 5 | 0 | 215 X | 101.7 | ○ | X |
| (small continuous casting | 1 to less than 2 | 5 | 7 | 168 X | 101.5 | ○ | X |
| machine) | 1 to less than 2 | 5 | 13 | 160 X | 100.9 | ○ | X |
| | 1 to less than 2 | 5 | 15 | 173 X | 100.5 | ○ | X |
| | 1 to less than 2 | 5 | 18 | 190 X | 99.6 | ○ | X |
| Comparative material 2 | 7 to 8 | 3 | 0 | 164 X | 102.2 | ○ | X |
| (SCR) | 7 to 8 | 5 | 2 | 157 X | 102.1 | ○ | X |
| Example material 1 | 7 to 8 | 5 | 4 | 148 ○ | 102.1 | ○ | ○ |
| (SCR) | 7 to 8 | 5 | 10 | 135 ○ | 102.2 | ○ | ○ |
| | 7 to 8 | 5 | 13 | 134 ○ | 102.4 | ○ | ○ |

TABLE 1-continued

| Experimental material | Oxygen conc. (mass ppm) | S conc. (mass ppm) | Ti conc. (mass ppm) | ϕ2.6 mm Semi-softening temperature (° C.) | ϕ2.6 mm Conductivity of soft material (% IACS) | Evaluation of dispersed particle size | Overall evaluation |
|---|---|---|---|---|---|---|---|
| | 7 to 8 | 5 | 20 | 130 ○ | 102.2 | ○ | ○ |
| | 7 to 8 | 5 | 25 | 132 ○ | 102.0 | ○ | ○ |
| | 7 to 8 | 5 | 37 | 134 ○ | 101.1 | ○ | ○ |
| | 7 to 8 | 5 | 40 | 135 ○ | 99.6 | ○ | ○ |
| | 7 to 8 | 5 | 55 | 148 ○ | 98.2 | ○ | ○ |
| Comparative material 3 (SCR) | 7 to 8 | 5 | 60 | 155 X | 97.7 | X Poor surface quality | X |
| Example material 2 (SCR) | Difficult to control stability at less than 2 | 5 | 13 | 145 ○ | 102.1 | ○ | Δ |
| | More than 2 and not more than 3 | 5 | 11 | 133 ○ | 102.2 | ○ | ○ |
| | 3 | 5 | 12 | 133 ○ | 102.2 | ○ | ○ |
| | 30 | 5 | 10 | 134 ○ | 102.0 | ○ | ○ |
| Comparative material 4 (SCR) | 40 | 5 | 14 | 134 ○ | 101.8 | X Poor surface quality | X |
| Example material 3 (SCR) | 7 to 8 | 2 | 4 | 134 ○ | 102.2 | ○ | ○ |
| | 7 to 8 | 10 | 13 | 135 ○ | 102.3 | ○ | ○ |
| | 7 to 8 | 12 | 14 | 136 ○ | 102.2 | ○ | ○ |
| | 7 to 8 | 11 | 19 | 133 ○ | 102.4 | ○ | ○ |
| | 7 to 8 | 12 | 20 | 133 ○ | 102.4 | ○ | ○ |
| Comparative material 5 | 7 to 8 | 18 | 13 | 162 X | 101.5 | ○ | X |
| Comparative material 6 (Cu (6N)) | | | | 127 to 130 ○ | 102.8 | Null | — |

conc.: concentration

Firstly, ϕ8 mm copper wires (wire rods) having concentrations of oxygen, sulfur and Ti shown in Table 1 were respectively made as experimental materials at a reduction ratio of 99.3%. The ϕ8 mm copper wire has been hot rolled by SCR continuous casting and rolling. Molten copper which was melted in a shaft furnace was poured into a ladle under a reductive gas atmosphere, the molten copper poured into the ladle was introduced into a casting pot under the same reductive gas atmosphere, and Ti was added in the casting pot, and then, it was introduced through a nozzle into a casting mold formed between a casting wheel and an endless belt, thereby making an ingot rod. The ϕ8 mm copper wire was made by hot rolling the ingot rod. The experimental materials were cold-drawn, and then, the semi-softening temperature and the conductivity in case of ϕ2.6 mm in size were measured, and also the dispersed particle size in the ϕ8 mm copper wire was evaluated.

The oxygen concentration was measured by an oxygen analyzer (Leco Oxygen Analyzer (Leco: registered trademark)). The respective concentrations of sulfur and Ti are the results of analysis by an ICP emission spectrophotometer.

After holding for one hour at each temperature of not more than 400° C., water quenching and a tensile test were carried out for the measurement in case of ϕ2.6 mm in size and the semi-softening temperature was derived from the results. The result of the tensile test at a room temperature and the result of the tensile test of the soft copper wire heat-treated in an oil bath at 400° C. for one hour were used. The temperature corresponding to a strength value obtained by adding the tensile strengths of the two tensile tests and dividing it by two was defined as a semi-softening temperature.

It is desirable that the dispersed particles be small in size and a large number of dispersed particles are distributed. The reason for this is that it is required to be small in size and large in number in order to function as a precipitation site of sulfur. Accordingly, it is judged as "Passed the test" when not less than 90% of dispersed particles have a diameter of not more than 500 nm Here, "size" is a size of a compound and means a size of a long diameter of the compound in a shape having long and short diameters. Meanwhile, "particle" indicates the TiO, $TiO_2$, TiS or Ti—O—S. In addition, "90%" indicates a ratio of the number of such particles to the total number of particles.

In Table 1, Comparative Material 1 is a result of experimentally forming a copper wire having a diameter of 8 mm under Ar atmosphere in an experimental laboratory using molten metal with 0 to 18 mass ppm of Ti added thereto.

While the semi-softening temperature was 215° C. at the Ti concentration of zero, the semi-softening temperature was lowered to the minimum temperature of 160° C. by the Ti addition of 13 mass ppm but was increased by an addition of 15 mass ppm and 18 mass ppm and the demanded softening temperature of not more than 148° C. was not obtained. Although the industrially demanded conductivity of not less than 98% IACS was satisfied, the overall evaluation was "X (Failed)".

Then, a ϕ8 mm copper wire (wire rod) was experimentally formed by the SCR continuous casting and rolling method while adjusting the oxygen concentration to be 7 to 8 mass ppm.

Among the samples experimentally formed by the SCR continuous casting and rolling method, Comparative Material 2 has the low Ti concentration (0 and 2 mass ppm) and the conductivity thereof was not less than 102% IACS, however, the semi-softening temperatures were respectively 164° C. and 157° C. which does not satisfy the demanded temperature of not more than 148° C., hence, the overall evaluation was "X".

Regarding Example Material 1, the results of samples having the substantially constant oxygen and sulfur concentrations (7 to 8 mass ppm and 5 mass ppm) and different Ti concentrations (4 to 55 mass ppm) are shown.

The Ti concentration range of 4 to 55 mass ppm is satisfactory because the softening temperature is not more than 148° C., the conductivity is not less than 98% IACS or not less than 102% IACS and the dispersed particle size is not more than 500 μm in not less than 90% of particles. In addition, the surface of the wire rod is also fine, which means that all product performances are satisfied (the overall evaluation is "○(Passed)").

Here, the conductivity of not less than 100% IACS is satisfied at the Ti concentration of 4 to 37 mass ppm and not less than 102% IACS is satisfied at the Ti concentration of 4 to 25 mass ppm. The conductivity of 102.4% IACS which is the maximum value was exhibited at the Ti concentration of 13 mass ppm, and the conductivity at around this concentration was a slightly lower value.

This is because, when the Ti is 13 mass ppm, sulfur in copper is trapped as a compound, and thus, the conductivity close to that of high purity copper (6N) is exhibited.

Therefore, it is possible to satisfy both of the semi-softening temperature and the conductivity by increasing the oxygen concentration and adding Ti.

Comparative Material 3 are samples in which the Ti concentration is increased to 60 mass ppm. Comparative Material 3 satisfies the demanded conductivity but has the semi-softening temperature of not less than 148° C., and therefore does not satisfy the product performance. Furthermore, the results shows that there were many surface flaws on the wire rod, hence, it was difficult to commercialize. Therefore, the preferable added amount of Ti is less than 60 mass ppm.

Next, Example Material 2 are samples having a sulfur concentration of 5 mass ppm, a Ti concentration of 13 to 10 mass ppm and various oxygen concentrations to examine the affect of the oxygen concentration.

Samples have largely different oxygen concentrations from more than 2 mass ppm to not more than 30 mass ppm. In this regard, however, the overall evaluation for less than 2 mass ppm of oxygen is Δ(not good) since it is difficult to produce and the stable manufacturing is not possible. In addition, it was found that the semi-softening temperature and the conductivity are both satisfied even when the oxygen concentration is increased to 30 mass ppm.

In addition, as shown in Comparative Material 4, there were many flaws on the surface of the wire rod in the case of 40 mass ppm of oxygen and it was in a condition which cannot be a commercial product.

Accordingly, adjusting the oxygen concentration to be in a range of more than 2 and not more than 30 mass ppm allows all characteristics of the semi-softening temperature, the conductivity of not less than 102% IACS and the dispersed particle size to be satisfied and also provides the wire rod with a fine surface, which means that all product performances can be satisfied.

The inventors see that the above-mentioned characteristics are satisfied since the added oxygen reduces equilibrium solid solution of Ti with respect to copper. In other words, it is understood that reduction in semi-softening temperature and improvement in conductivity in Examples are resulted from a decrease in the amounts of Ti and S dissolved in the copper. Oxygen itself has a low impact on softening but reduces solid solutions of Ti and S in Example Materials. The decrease in the solid solutions of Ti and S is considered to be caused by formation of precipitation, etc., of compound such as TiO, TiS, Ti—O—S or $TiO_2$, and in fact, presence of a compound such as TiO, TiS, Ti—O—S or $TiO_2$ has been confirmed as described above.

Next, Example Material 3 is an example of samples each having an oxygen concentration relatively close to a Ti concentration and a sulfur concentration varied from 4 to 20 mass ppm. In Example Material 3, it was not possible to realize a sample having sulfur of less than 2 mass ppm because of raw material but it is possible to satisfy both the semi-softening temperature and the conductivity by controlling the concentrations of Ti and sulfur.

In case of Comparative Material 5 in which the sulfur concentration is 18 mass ppm and the Ti concentration is 13 mass ppm, the semi-softening temperature was as high as 162° C. and could not satisfy requisite characteristics. In addition, the surface quality of the wire rod is specifically poor, and it was thus difficult to commercialize.

As described above, it was found that, when the sulfur concentration is 2 to 12 mass ppm, all characteristics which are the semi-softening temperature, not less than 102% IACS of conductivity and the dispersed particle size are satisfied, the surface of the wire rod is also fine and all product performances are satisfied.

Meanwhile, examination results when using high purity copper (6N) are shown as Comparative Material 6. The semi-softening temperature was 127 to 130° C., the conductivity was 102.8% IACS and the particles having the dispersed particle size of not more than 500 nm were not observed at all.

TABLE 2

| Experimental material | Molten copper temp. (° C.) | Oxygen conc. (mass ppm) | S conc. (mass ppm) | Ti conc. (mass ppm) | Hot-rolling temp. (° C.) Initial-Final | ϕ2.6 mm Semi-softening temp. (° C.) | ϕ2.6 mm Conductivity of soft material (% IACS) | WR Surface quality | Evaluation of dispersed particle size | Overall evaluation |
|---|---|---|---|---|---|---|---|---|---|---|
| Comparative | 1350 | 15 | 7 | 13 | 950-600 | 148 | 101.7 | X | X | X |
| Material 7 | 1330 | 16 | 6 | 11 | 950-600 | 147 | 101.2 | X | X | X |
| Example | 1320 | 15 | 5 | 13 | 880-550 | 143 | 102.1 | ○ | ○ | ○ |
| Material 4 | 1300 | 16 | 6 | 13 | 880-550 | 141 | 102.3 | ○ | ○ | ○ |
| | 1250 | 15 | 6 | 14 | 880-550 | 138 | 102.1 | ○ | ○ | ○ |
| | 1200 | 15 | 6 | 14 | 880-550 | 135 | 102.1 | ○ | ○ | ○ |
| Comparative Material 8 | 1100 | 12 | 5 | 12 | 880-550 | 135 | 102.1 | X | ○ | X |
| Comparative Material 9 | 1300 | 13 | 6 | 13 | 950-600 | 147 | 101.5 | ○ | X | X |
| Comparative Material 10 | 1350 | 14 | 6 | 12 | 880-550 | 149 | 101.5 | X | X | X |

conc.: concentration

Table 2 shows the molten copper temperature and the rolling temperature as the manufacturing conditions.

Regarding Comparative Material 7, the results of experimentally forming ϕ8 mm wire rods at the slightly high molten copper temperature of 1330 to 1350° C. and at the rolling temperature of 950 to 600° C. are shown.

Although this Comparative Material 7 satisfies the semi-softening temperature and the conductivity, there are dispersed particles having a size of about 1000 nm and more than 10% of particles were not less than 500 nm Therefore, it is judged as inapplicable.

Regarding Example Material 4, the results of experimentally forming a ϕ8 mm wire rod at the molten copper temperature of 1200 to 1320° C. and at the slightly low rolling temperature of 880 to 550° C. are shown. Example Material 4 was satisfactory in the surface quality of wire and the dispersed particle size, and the overall evaluation was "○".

Regarding Comparative Material 8, the results of experimentally forming a ϕ8 mm wire rod at the molten copper temperature of 1100° C. and at the slightly low rolling temperature of 880 to 550° C. are shown. Comparative Material 8 was not suitable as a commercial product since there were many surface flaws on the wire rod due to the low molten copper temperature. This is because the flaws are likely to be generated at the time of rolling since the molten copper temperature is low.

Regarding Comparative Material 9, the results of experimentally forming a ϕ8 mm wire rod at the molten copper temperature of 1300° C. and at the slightly high rolling temperature of 950 to 600° C. are shown. The wire rod in Comparative Material 9 had satisfactory surface quality since the hot rolling temperature is high but had large dispersed particles, and the overall evaluation is "X".

Regarding Comparative Material 10, the results of experimentally forming a ϕ8 mm wire rod at the molten copper temperature of 1350° C. and at the slightly low rolling temperature of 880 to 550° C. are shown. In Comparative Material 10, the large dispersed particles are present since the molten copper temperature is high, and the overall evaluation is "X".

[Softening Characteristics of Soft Dilute-Copper Alloy Wire]

Table 3 is a table to examine Vickers hardness (Hv) of samples, which are Comparative Material 11 using an oxygen-free copper wire and Example Material 5 using a soft dilute-copper alloy wire made of low-oxygen copper containing 13 mass ppm of Ti, after annealing at different annealing temperatures for 1 hour.

The sample having the same alloy composition as that described in Example Material 1 of Table 1 was used as Example Material 5. The samples having a diameter of 2.6 mm were used. This table shows that Vickers hardness (Hv) of Comparative Material 11 is at the equivalent level to that of Example Material 5 at the annealing temperature of 400° C., as well as at the annealing temperature of 600° C. This shows that the soft dilute-copper alloy wire of the invention has sufficient softening characteristics and is especially excellent in softening characteristics at the annealing temperature of more than 400° C. even in comparison to an oxygen-free copper wire.

TABLE 3

| | 20° C. | 400° C. | 600° C. |
|---|---|---|---|
| Example Material 5 | 120 | 52 | 48 |
| Comparative Material 11 | 124 | 53 | 56 |

(Unit: Hv)

[Examination of Proof Stress and Bending Life of Soft Dilute-Copper Alloy Wire]

Table 4 is a table to examine variation in a 0.2% proof stress value of samples, which are Comparative Material 12 using an oxygen-free copper wire and Example Material 6 using a soft dilute-copper alloy wire made of low-oxygen copper containing 13 mass ppm of Ti, after annealing at different annealing temperatures for 1 hour. The samples having a diameter of 2.6 mm were used.

According to this table, it is understood that the 0.2% proof stress value of Comparative Material 12 and that of Example Material 6 are at the equivalent level at the annealing temperature of 400° C., and Example Material 6 and Comparative Material 12 exhibit nearly the same 0.2% proof stress value at the annealing temperature of 600° C.

TABLE 4

| | 20° C. | 250° C. | 400° C. | 600° C. | 700° C. |
|---|---|---|---|---|---|
| Example Material 6 | 421 | 80 | 58 | 35 | 25 |
| Comparative Material 12 | 412 | 73 | 53 | 32 | 24 |

(Unit: MPa)

Figure 8:
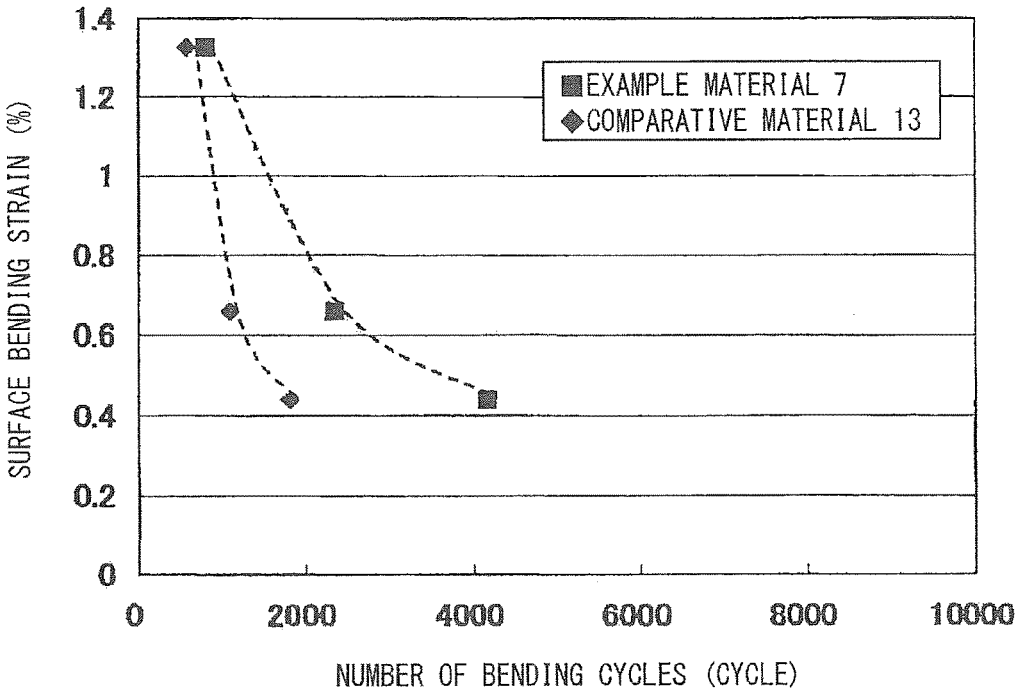
FIG. 8 is a graph showing bending lives of Comparative Material 13 using an oxygen-free copper wire and Example Material 7 using a soft dilute-copper alloy wire made of low-oxygen copper with Ti added thereto, which are measured after annealing treatment at 400° C. for 1 hour.

Next, as for a long bending life which is required for the soft dilute-copper alloy wire of the invention, FIG. 8 shows the measurement results of the bending life of Comparative Material 13 using an oxygen-free copper wire and that of Example Material 7 using a soft dilute-copper alloy wire made of low-oxygen copper with Ti added thereto. Here, the samples used are a 0.26 mm diameter wire rod annealed at the annealing temperature of 400° C. for 1 hour, Comparative Material 13 has the same element composition as that of Comparative Material 11 and the sample having the same element composition as that of Example Material 5 was used as Example Material 7.

Figure 7:
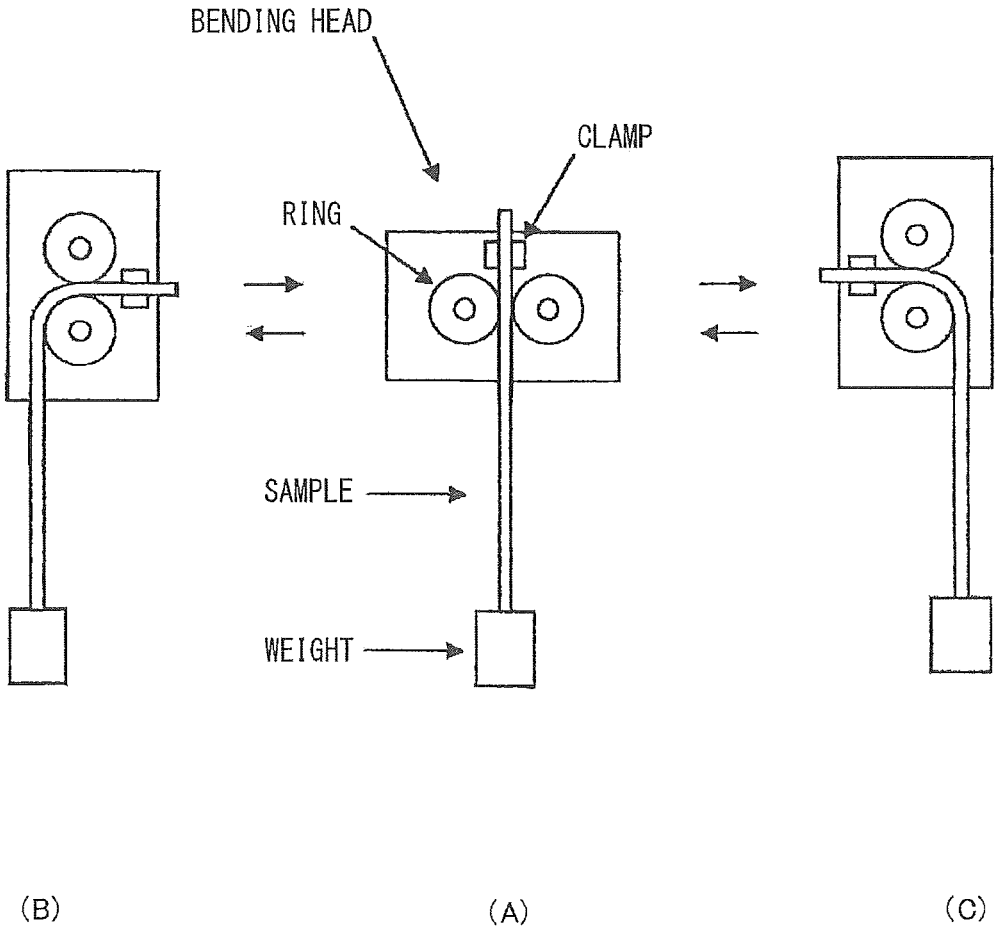
FIG. 7 is a schematic view showing a bending fatigue test.

Here, a bending fatigue test was conducted as a method of measuring the bending life. The bending fatigue test is a test in which a load is applied to a sample to impart tension and compression strain to the surface thereof by cyclic bending. The bending fatigue test is shown in FIG. 7. The sample is placed between bending jigs (which are referred to as "ring" in the drawing) as shown in (A) and is bent by a 90° rotation of the jigs as shown in (B) while the load is still applied. This operation generates a compressive strain on a surface of the wire rod in contact with the bending jig and a tensile strain on an opposite surface. After that, it returns to a state (A) again. Then, the sample is bent by a 90° rotation in a direction opposite to the direction shown in (B). This also generates a compressive strain on the surface of the wire rod in contact with the bending jig and a tensile strain on the opposite surface, and it becomes a state (C). Then, it returns to the initial state (A) from (C). One bending fatigue cycle consisting of (A)-(B)-(A)-(C)-(A) requires 4 seconds. The surface bending strain can be derived by the following formula.

$$\text{Surface bending strain}(\%)=r/(R+r)\times 100(\%)$$

R: bending radius of wire (30 mm), r: radius of wire

The test data of FIG. 8 shows that the bending life of Example Material 7 of the invention is longer than that of Comparative Material 13.

Figure 9:
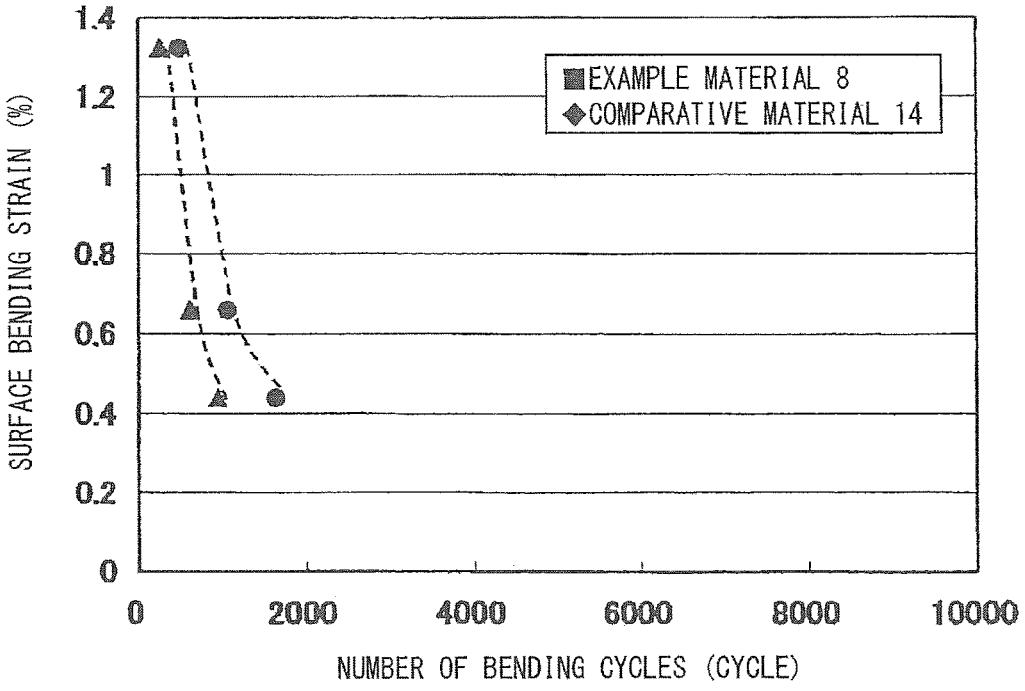
FIG. 9 is a graph showing bending lives of Comparative Material 14 using an oxygen-free copper wire and Example Material 8 using a soft dilute-copper alloy wire made of low-oxygen copper with Ti added thereto, which are measured after annealing treatment at 600° C. for 1 hour.

In addition, the results of measuring the bending lives of Comparative Material 14 using an oxygen-free copper wire and Example Material 8 using a soft dilute-copper alloy wire made of low-oxygen copper with Ti added thereto are shown in FIG. 9. Here, the samples used are a 0.26 mm diameter wire rod annealed at the annealing temperature of 600° C. for 1 hour, Comparative Material 14 has the same element composition as that of Comparative Material 11 and the sample having the same element composition as that of Example Material 5 was used as Example Material 8. The method of measuring the bending life was conducted under the same conditions as the measuring method shown in FIG. 8. Also in this case, Example Material 8 of the invention exhibits the longer bending life than Comparative Material 14. It is understood that this is resulted from that the Example Materials 7 and 8 exhibit a greater 0.2% proof stress value than Comparative Materials 13 and 14 under any annealing conditions.

[Examination Of Crystalline Structure Of Soft Dilute-Copper Alloy Wire]

Figure 1:
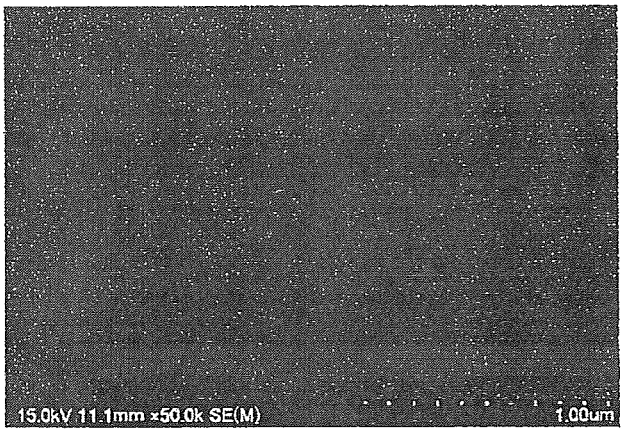
FIG. 1 is a SEM image showing a TiS particle.
Figure 10:
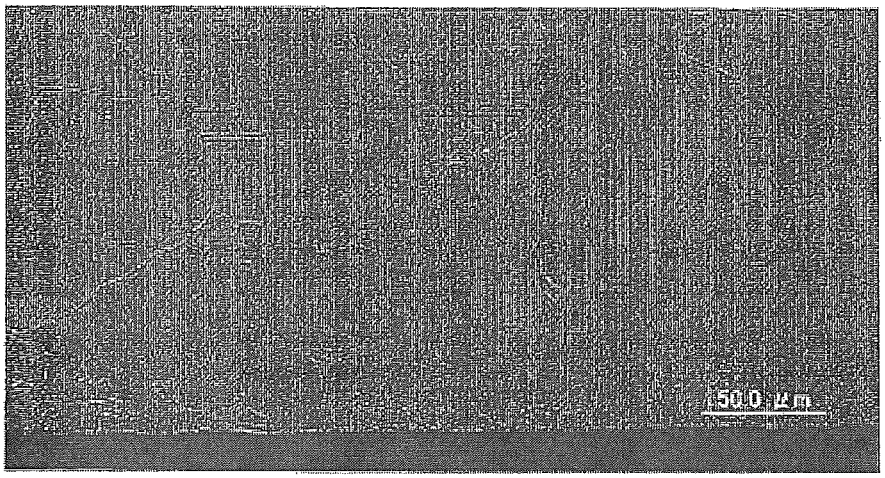
FIG. 10 is a photograph showing a cross section structure across-the-width of Example Material 8.
Figure 11:
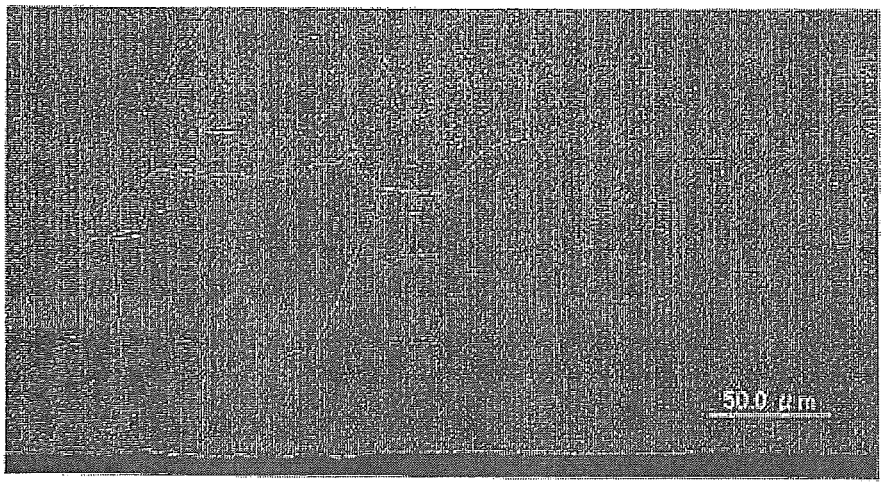
FIG. 11 is a photograph showing a cross section structure across-the-width of a sample of Comparative Material 14.

Meanwhile, FIG. 10 is a photograph showing a cross section structure across-the-width of the sample of Example Material 8 and FIG. 1 is a photograph showing a cross section structure across-the-width of Comparative Material 14. FIG. 11 shows a crystalline structure of Comparative Material 14 and FIG. 10 shows a crystalline structure of Example Material 8. These show that crystal grains having an equal size all around are uniformly aligned from the surface to the middle portion in the crystalline structure of Comparative Material 14. In contrast, the size of crystal grain in the crystalline structure of Example Material 8 is uneven as a whole and what is notable here is that a crystal grain size in a thin layer formed on the sample near a surface thereof in a cross-sectional direction is extremely smaller than that of the inner side.

The inventors consider that a fine crystal grain layer appeared as a surface layer, which is not formed in Comparative Material 14, contributes to improve bending characteristics of Example Material 8.

This would generally be understood that uniformly coarsened crystal grains are formed by recrystallization as is in Comparative Material 14 if annealing treatment is carried out at an annealing temperature of 600° C. for 1 hour, however, a fine crystal grain layer remains as a surface layer in the invention even after the annealing treatment at the annealing temperature of 600° C. for 1 hour, hence, it is considered that a soft dilute-copper alloy material with satisfactory bending characteristics is obtained even though it is a soft copper material.

Figure 12:
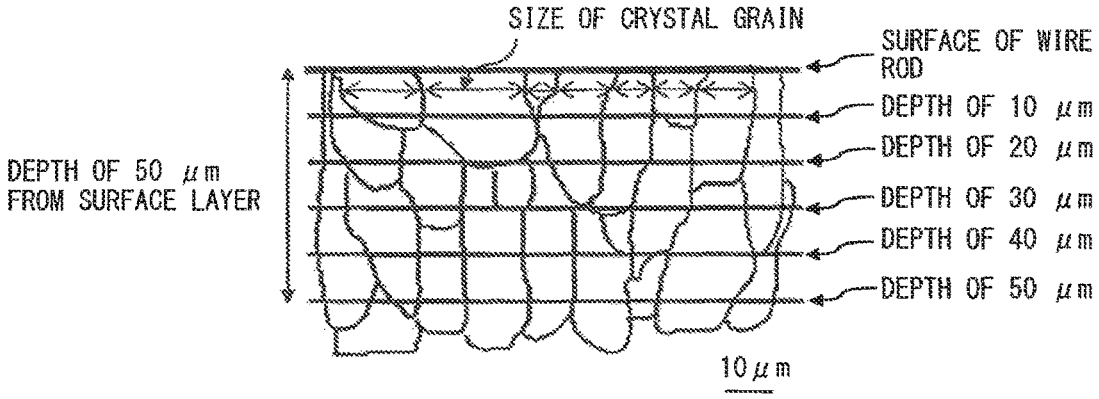
FIG. 12 is an explanatory diagram illustrating a method of measuring an average crystal grain size in a surface layer of a sample.

Then, average crystal grain sizes in the surface layers of the samples of Example Material 8 and Comparative Material 14 were measured based on the cross-sectional images of the crystalline structures shown in FIGS. 10 and 11. Here, as a method of measuring an average crystal grain size in the surface layer, a crystal grain size was measured within 1 mm in length from a surface of a widthwise cross section of a 0.26 mm diameter up to a depth of 50 μm at intervals of 10 μm in a depth direction as shown in FIG. 12, and an average of the actual measured values was defined as an average crystal grain size in the surface layer.

As a result of the measurement, the average crystal grain size in the surface layer of Comparative Material 14 was 50 μm, and is largely different from that of Example Material 8 which was 10 μm. It is believed that development of cracks caused by the bending fatigue test is suppressed since the average crystal grain size in the surface layer is fine, which extends the bending fatigue life (cracks are developed along a crystal grain boundary when the crystal grain size is large. However, the development of cracks is suppressed when the crystal grain size is small since a developing direction thereof is changed). It is considered that this is the reason why a large difference in the bending characteristics is caused between Comparative Materials and Example Materials as described above.

Meanwhile, average crystal grain sizes in the surface layers of Example Material 6 and Comparative Material 12 each having a diameter of 2.6 mm were obtained by measuring crystal grain sizes within 10 mm in length from the surface of a widthwise cross section of a 2.6 mm diameter up to a depth of 50 μm in a depth direction.

As a result of the measurement, the average crystal grain size in the surface layer of Comparative Material 12 was 100 μm and that of Example Material 6 was 20 μm.

In order to achieve the effects of the invention, the average crystal grain size in the surface layer is preferably not more than 20 μm as the upper limit and is supposed to be not less than 5 μm in view of a limit value for production.

[Examination of Crystalline Structure of Soft Dilute-Copper Alloy Material]

Figure 13:
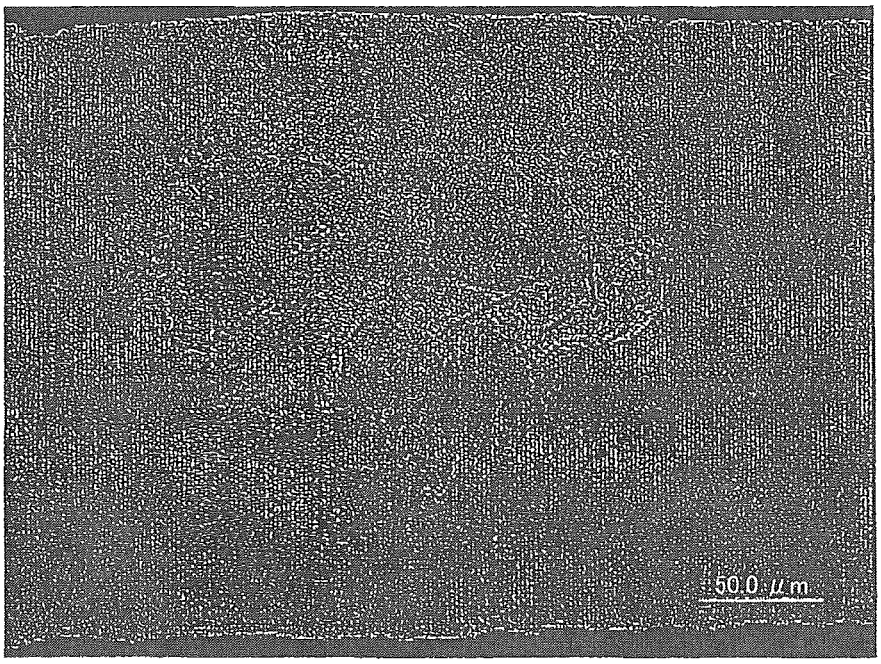
FIG. 13 is a photograph showing a cross section structure across-the-width of Example Material 9.
Figure 14:
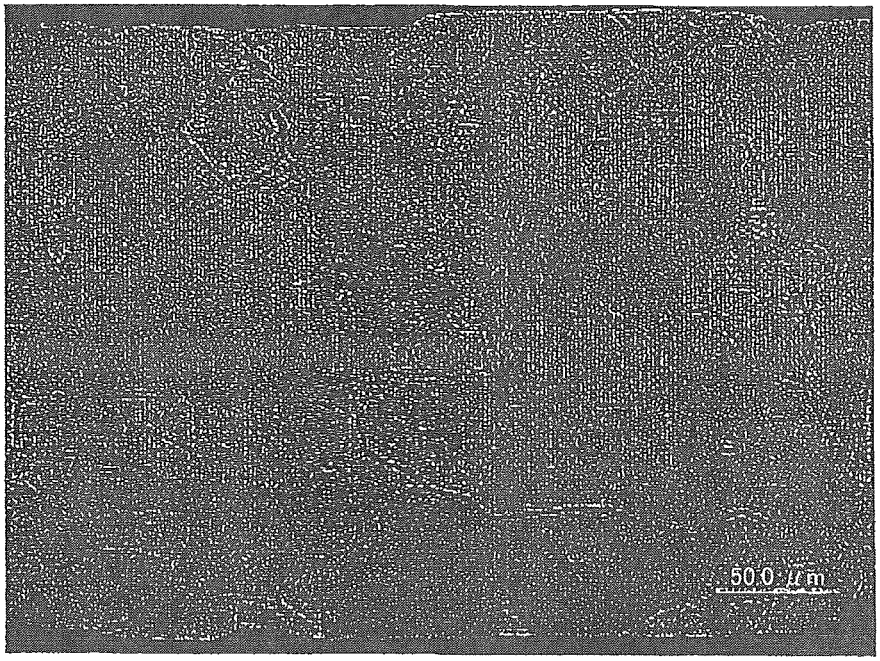
FIG. 14 is a photograph showing a cross section structure across-the-width of a sample of Comparative Material 15.

FIG. 13 is a photograph showing a cross section structure across-the-width of a sample of Example Material 9 and FIG. 14 is a photograph showing a cross section structure across-the-width of Comparative Material 15. FIG. 13 shows a crystalline structure of Example Material 9 and FIG. 14 shows a crystalline structure of Comparative Material 15.

Example Material 9 is a 0.26 mm diameter wire rod having the highest soft material conductivity shown in the third row of Example Material 1 in Table 1. Example Material 9 is made through annealing treatment at an annealing temperature of 400° C. for 1 hour.

Comparative Material 15 is a 0.26 mm diameter wire rod formed of oxygen-free copper (OFC). Comparative Material 15 is made through annealing treatment at an annealing temperature of 400° C. for 1 hour. Conductivity of Example Material 9 and that of Comparative Material 15 are shown in Table 5.

TABLE 5

| | Conductivity of Soft Material (% IACS) |
|---|---|
| Example Material 9 | 102.4 |
| Comparative Material 15 | 101.8 |

As shown in FIGS. 13 and 14, it is understood that crystal grains having an equal size all around are uniformly aligned from the surface to the middle portion in the crystalline structure of Comparative Material 15. In contrast, the crystalline structure of Example Material 9 has a difference in the size of crystal grain between the surface layer and the inner side, such that a crystal grain size of the inner side is extremely larger than that in the surface layer.

In Example Material 9, S in copper constituting a conductor which is processed to have a diameter of, e.g., ϕ2.6 mm or ϕ0.26 mm is trapped in the form of Ti—S or Ti—O—S. In addition, oxygen (O) included in copper is present in the form of $Ti_xO_y$, e.g., $TiO_2$, and is precipitated in a crystal grain or at crystal grain boundary.

Therefore, in Example Material 9, recrystallization is likely to proceed when copper is annealed to recrystallize the crystalline structure, and thus, the crystal grains of the inner side grow to be large. Accordingly, when passing an electric current through Example Material 9, electron flow is less disturbed as compared to Comparative Material 15, hence, electrical resistance decreases. Therefore, the conductivity (% IACS) of Example Material 9 is greater than that of Comparative Material 15.

As a result, a product using Example Material 9 is soft and can have an improved conductivity and improved bending characteristics. A conventional conductor requires high temperature annealing treatment in order to recrystallize the crystalline structure to have a size equivalent to that in Example Material 9. However, S is re-dissolved when the annealing temperature is too high. In addition, there is a problem that the conventional conductor is softened when recrystallized and the bending characteristics decreases. Example Material 9 described above has a feature that, while crystal grains of the inner side become large and the material becomes soft since it can be recrystallized without twining at the time of annealing, the bending characteristics do not decrease since fine crystals remain in the surface layer.

[Relation Between Elongation Characteristics and Crystalline Structure of Soft Dilute-Copper Alloy Wire]

Figure 15:
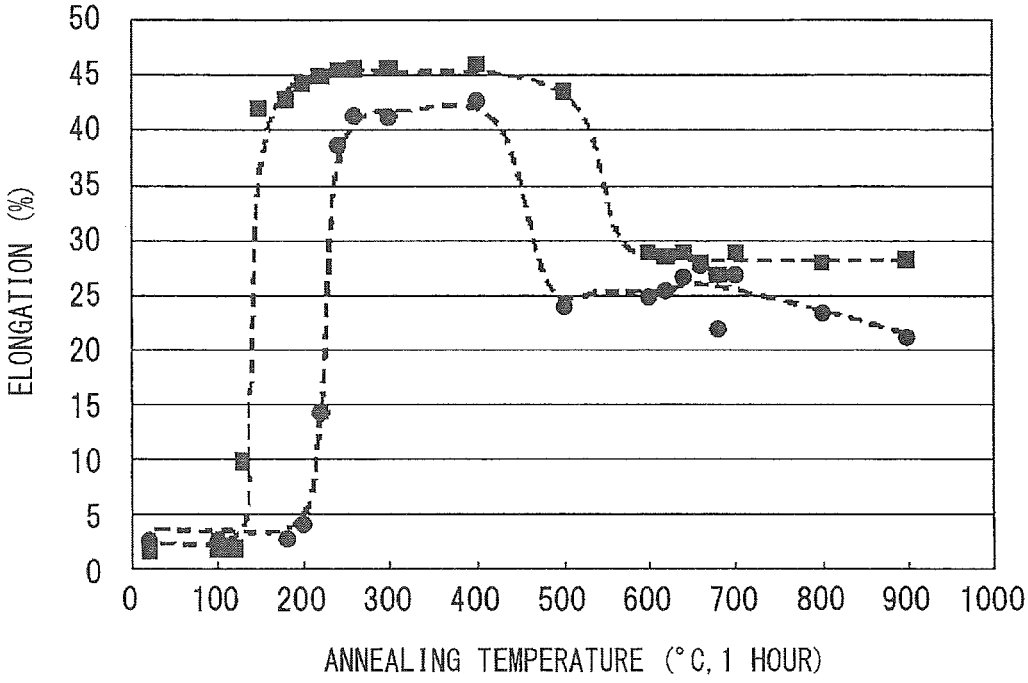
FIG. 15 is a graph showing a relation between an annealing temperature and elongation (%) of Example Material 9 and Comparative Material 15.

FIG. 15 is a graph for verifying variation in elongation (%) of samples, which are Comparative Material 15 using a 2.6 mm-diameter oxygen-free copper wire and Example Material 9 using a 2.6 mm-diameter soft dilute-copper alloy wire made of low-oxygen copper containing 13 mass ppm of Ti, after annealing at different annealing temperatures for 1 hour. The samples here were formed by drawing from a diameter of 8 mm to a diameter of 2.6 mm (at a reduction ratio of 90%). The sample having the same composition as that described in the top raw of Comparative Material 1 of Table 1 was used as Comparative Material 5. In FIG. 15, a square point indicates Example Material 9 and a circle point indicates Comparative Material 15.

According to this graph, it is understood that Example Material 9 exhibits better elongation characteristics than Comparative Material 15 at an annealing temperature of more than 100° C. in a wide range of around 130° C. to 900° C. It is understood that better elongation characteristics than those of Comparative Material 15 is exhibited especially in an annealing temperature range of 150° C. to less than 600° C. Particularly, it is understood that the elongation value of not less than 40% is provided at an annealing temperature of around 150° C. to 550° C. and the elongation value of not less than 45% is provided at an annealing temperature of 260° C. to 400° C.

Table 6 shows elongation values of the samples of Example Material 9 and those of the samples of Comparative Example 15 after heat treatment for 1 hour under each temperature conditions.

TABLE 6

| | Heat Treatment Conditions × 1 h | | | | | | | | |
|---|---|---|---|---|---|---|---|---|---|
| Samples | 150° C. | 180° C. | 200° C. | 220° C. | 240° C. | 260° C. | 300° C. | 400° C. | 500° C. |
| Example Material 9 (%) | 42.0 | 42.8 | 44.1 | 44.9 | 45.4 | 45.5 | 45.6 | 46.0 | 43.5 |
| Comparative Material 15 (%) | — | 2.7 | 4.1 | 14.2 | 38.7 | 41.3 | 41.2 | 42.7 | 24 |

In order to quantitatively compare the elongation values of the samples of Example Material 9 and those of the samples of Comparative Material 15, an average elongation value of Comparative Material 15 in a post-annealing treatment state was derived and compared with the elongation values of the samples of Example Material 9.

In general, the post-annealing treatment state of the soft copper wire indicates the wire with the elongation value of not less than about 25%. Therefore, the sample having the elongation value of not less than 25% which is generally required for the soft copper wire was used as a benchmark here.

The samples of the Comparative Material 15 after heat treatment for 1 hour under the temperature condition of not more than 220° C. were practically far from the post-annealing treatment state. Therefore, the elongation value was not measured in the heat treatment for 1 hour under the temperature condition of not more than 150° C. On the other hand, the sample of Comparative Material 15 after heat treatment for 1 hour under the temperature condition of 500° C. exhibits the elongation value of 24% and was regarded as the excessively annealed state.

Therefore, an average of elongation values at four points from 240° C. to 400° C., which are regarded as a soft copper wire in the post-annealing treatment state, was derived (41.0%) as the average elongation value of the samples of Comparative Material 15, and this average as a benchmark was compared with the elongation values of the samples of Example Material 9. Then, it was found that, among the samples of Example Material 9, the samples which were heat-treated for 1 hour under the temperature conditions of 150° C. to 500° C. all exhibit an excellent elongation value which is 1% or more higher than the average elongation value (41.0%) of the samples of Comparative Material 15 as oxygen-free copper wires.

Figure 16:
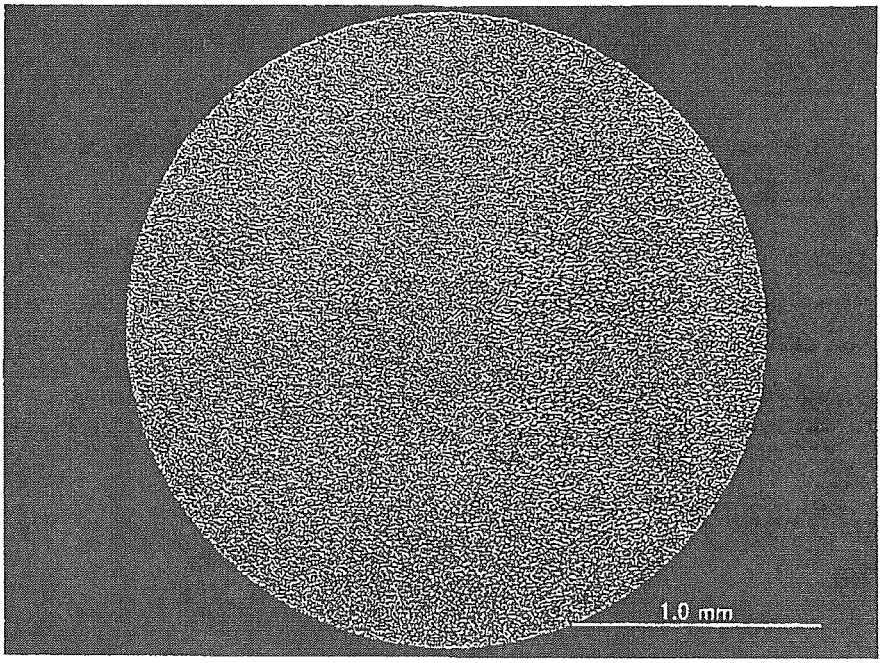
FIG. 16 is a photograph showing a cross section of Example Material 9 annealed at a temperature of 500° C.

Meanwhile, FIG. 16 shows a cross sectional photograph of a copper wire of Example Material 9 at a temperature of 500° C. Referring FIG. 16, a fine crystalline structure is formed on the entire cross section of the copper wire and it appears that the fine crystalline structure contributes to the elongation characteristics. On the other hand, secondary recrystallization has proceeded in the cross section structure of Comparative Material 15 at the annealing temperature of 500° C., crystal grains in the cross section structure were coarsened as compared to the crystalline structure of FIG. 16, and it is thus considered that the elongation characteristics are decreased.

Figure 17:
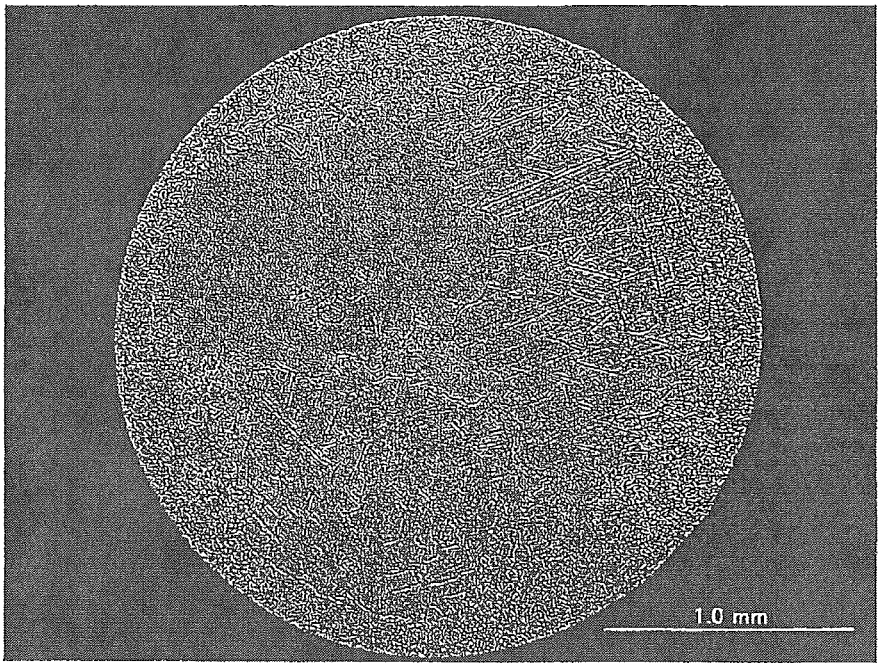
FIG. 17 is a photograph showing a cross section of Example Material 9 annealed at a temperature of 700° C.

Then, FIG. 17 shows a cross sectional photograph of a copper wire of Example Material 9 at a temperature of 700° C. It is found that the crystal grain size in the surface layer on the cross section of the copper wire is extremely smaller than the crystal grain size of the inner side. Although secondary recrystallization has proceeded in the crystalline structure of the inner side, a fine crystal grain layer remains as the outer layer. It is considered that the elongation characteristics are maintained in Example Material 9 since the fine crystal layer remains as the surface layer even though the crystalline structure of the inner side grows to be large.

Figure 18:
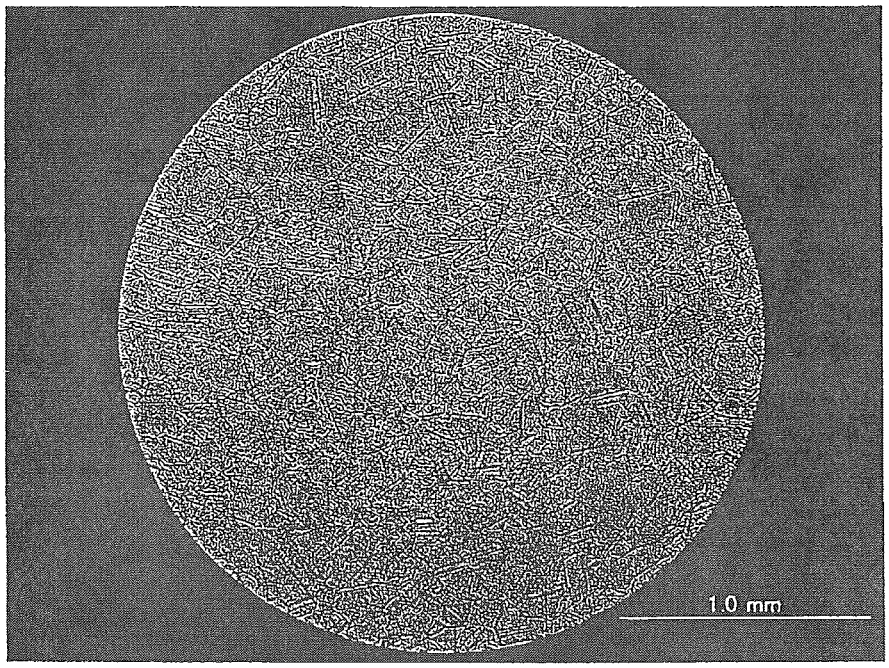
FIG. 18 is a photograph showing a cross section of Comparative Material 15.

In contrast, crystal grains having a substantially equal size all around are uniformly aligned from the surface to the middle in the cross section structure of Comparative Material 15 shown in FIG. 18 and secondary recrystallization has proceeded in the entire cross section structure. It is therefore considered that the elongation characteristics of Comparative Material 15 in a high temperature range of not less than 600° C. are lower than those of Example Material 9.

As described above, since Example Material 9 exhibits better elongation characteristics than Comparative Material 15, it is advantageous in that handling properties are excellent at the time of manufacturing a twisted wire using this conductor, bending resistance characteristics are excellent and it is easy to lay a cable due to flexibility.

In addition, Example Material 9 has an average crystal grain size of not more than 20 μm at least in a surface layer having a depth of 50 μm from the surface, and has an excellent elongation value which is 1% or more higher than the average elongation value of the heat-treated oxygen-free copper wire. Therefore, if Example Material 9 is used for, e.g., an insulated copper wire of a multiwire circuit board, it is advantageous in that it is possible to reduce risk of breaking of wire during wiring work as compared to a case of using a conventional oxygen-free copper wire even if crossover portions, in which plural insulated copper wires each having an insulation layer formed on a surface of a copper wire intersect one another, are formed and fused onto an insulating substrate having adhesive, which allows reliability of wiring to be increased.

Although the embodiments and modifications of the invention have been described above, the invention according to claims is not to be limited to the above-described embodiments and modifications. Further, please note that all combinations of the features described in the embodiments and modifications are not necessary to solve the problem of the invention.

The invention claimed is:

1. A soft dilute-copper alloy wire, comprising:

a drawn and annealed at 450 ° C. to 500 ° C. soft dilute-copper material consisting of copper, not lower than 2 mass ppm and not higher than 12 mass ppm of sulfur, higher than 2 mass ppm and not higher than 30 mass ppm of oxygen, and not lower than 4 mass ppm and not higher than 55 mass ppm of titanium, wherein the soft dilute-copper alloy wire further comprises:

an average crystal grain size of not more than 20 μm in a surface layer having a depth of 50 μm from a surface; and an elongation of not less than 40% after a wire drawing processing at a reduction ratio of 90% and annealing.

2. The soft dilute-copper alloy wire according to claim 1, wherein the soft dilute-copper alloy wire is not less than 98% IACS in conductivity.

3. The soft dilute-copper alloy wire according to claim 1, wherein the soft dilute-copper alloy wire further comprises a plating layer formed on a surface thereof.

4. A soft dilute-copper alloy twisted wire, comprising a plurality of ones of the soft dilute-copper alloy wire according to claim 1 that are twisted together.

5. An insulated wire, comprising:

the soft dilute-copper alloy twisted wire according to claim 4, and an insulation layer provided therearound.

6. An insulated wire, comprising:

the soft dilute-copper alloy wire according to claim 1; and an insulation layer provided therearound.

7. A composite cable, comprising:

a plurality of ones of the insulated wire according to claim 6 arranged in a shield layer; and a sheath provided on an outer periphery of the shield layer.

8. A coaxial cable, comprising:

a central conductor formed by twisting together a plurality of ones of the soft dilute-copper alloy wire according to claim 1, an insulation cover formed on an outer periphery of the central conductor;

an outer conductor comprising copper or copper alloy arranged on an outer periphery of the insulation cover; and a jacket layer provided on an outer periphery thereof.

9. A composite cable, comprising:

a plurality of ones of the coaxial cable according to claim 8 arranged in a shield layer; and a sheath provided on an outer periphery of the shield layer.

10. The soft dilute-copper alloy wire according to claim 1, wherein a softening temperature of the soft dilute-copper alloy wire is not more than 148 ° C. when the reduction ratio is 90%.

11. The soft dilute-copper alloy wire according to claim 1, wherein the titanium is in a range from 4 mass ppm to 37 mass ppm.

12. The soft dilute-copper alloy wire according to claim 1, wherein the titanium is in a range from 4 mass ppm to 25 mass ppm.

13. The soft dilute-copper alloy wire according to claim 12, wherein the sulfur is in a range from 3 mass ppm to 12 mass ppm.

14. The soft dilute-copper alloy wire according to claim 13, wherein the oxygen is in a range from 7 mass ppm to 8 mass ppm.

15. The soft dilute-copper alloy wire according to claim 1, wherein the average crystal grain size is more than 5 μm.

16. The soft dilute-copper alloy wire according to claim 1, wherein the soft dilute-copper alloy wire is not less than 102% IACS in conductivity.

17. The soft dilute-copper alloy wire according to claim 1, wherein the sulfur is in a range from 3 mass ppm to 12 mass ppm.

18. The soft dilute-copper alloy wire according to claim 1, wherein the oxygen is in a range from 7 mass ppm to 8 mass ppm.

* * * * *